US006560783B2

(12) United States Patent
Cannings

(10) Patent No.: US 6,560,783 B2
(45) Date of Patent: May 13, 2003

(54) HEADBAND FOR HOLDING HAIRS OFF OF FOREHEAD AND OUT OF FACE, AND METHOD OF MAKING THE SAME

(76) Inventor: Kelly Cannings, 765 Dunrobin Dr., Kamloops, BC (CA), V1S 1V8

( * ) Notice: Subject to any disclaimer, the term of this patent is extended or adjusted under 35 U.S.C. 154(b) by 0 days.

(21) Appl. No.: 09/797,575

(22) Filed: Mar. 5, 2001

(65) Prior Publication Data

US 2002/0120976 A1 Sep. 5, 2002

(51) Int. Cl.[7] ..... A41D 20/00
(52) U.S. Cl. ..... 2/171; 2/DIG. 11
(58) Field of Search ..... 2/171, 209, 181, 2/181.6, 183, DIG. 11; D2/894

(56) References Cited

U.S. PATENT DOCUMENTS

| | | | | |
|---|---|---|---|---|
| 1,207,574 A | | 12/1916 | Lewis | |
| 1,481,778 A | | 1/1924 | Salomans | |
| 1,622,324 A | | 3/1927 | Lettre | |
| 1,633,586 A | | 6/1927 | Hunter | |
| 1,697,919 A | * | 1/1929 | Knepper | |
| 2,783,474 A | * | 3/1957 | Campagna et al. | 2/171 |
| 3,466,664 A | * | 9/1969 | Militello | 2/171 |
| 3,528,308 A | | 9/1970 | McBride | |
| 4,639,977 A | | 2/1987 | Howard | |
| 4,742,581 A | * | 5/1988 | Rosenthal | 2/181 |
| 4,937,885 A | * | 7/1990 | Gregg | 2/196 |
| D338,551 S | * | 8/1993 | Teague et al. | D2/514 |
| D339,677 S | | 9/1993 | Xang | |
| D365,918 S | * | 1/1996 | Izebu et al. | D2/894 |
| 5,640,721 A | * | 6/1997 | Jackson | 2/171 |
| 5,774,096 A | | 6/1998 | Usuki | |
| 5,845,654 A | | 12/1998 | Johnson | |
| 5,906,006 A | * | 5/1999 | Castro, Jr. | 2/207 |
| 5,915,532 A | * | 6/1999 | Williams | 2/171 |
| D413,710 S | * | 9/1999 | De Rugeriis | D2/894 |
| 6,076,532 A | * | 6/2000 | Thomas et al. | 132/273 |
| 6,227,011 B1 | * | 5/2001 | Cortinovis | 66/171 |
| 6,260,206 B1 | * | 7/2001 | MacDonald et al. | 2/181 |
| 6,269,488 B1 | * | 8/2001 | Jurgensen et al. | 2/171 |
| 6,311,698 B1 | * | 11/2001 | Vaughn et al. | 132/212 |

FOREIGN PATENT DOCUMENTS

| | | |
|---|---|---|
| WO | 98/31244 | 7/1998 |

* cited by examiner

*Primary Examiner*—John J. Calvert
*Assistant Examiner*—Alissa L. Hoey
(74) *Attorney, Agent, or Firm*—I. Zborovsky

(57) ABSTRACT

A headband for holding hairs off of forehead and out of face has a continuous non-elastic cord which has an inner size exceeding an outer size of a head of a user, and a fastener provided with a structure through which at least a portion of the cord can pass, so that by displacing the fastener relative to the cord, a front portion of the cord is reducible to fit exactly the head of the user.

7 Claims, 1 Drawing Sheet

HEADBAND FOR HOLDING HAIRS OFF OF FOREHEAD AND OUT OF FACE, AND METHOD OF MAKING THE SAME

BACKGROUND OF THE INVENTION

The present invention relates to headband for holding hairs off of forehead and out of face, and a method for making the same.

It is known that short hairs or so-called "wispees" are found on a hairline, and they are not long enough to be pulled back into a ponytail or restrained in any way. People with long or short hair have experienced frustrations with wispees, especially active people. It is believed to be advisable to provide a headband which can restrain the wispees.

Some of headbands are disclosed in U.S. Pat. No. 1,207,574; 1,481,778; 1,622,324; 1,633,586; 3,529,308; 4,639,977; 5,774,096; 5,845,654; design patent 339, 677 and patent document WO 98/31244.

SUMMARY OF THE INVENTION

Accordingly, it is an object of present invention to provide a headband which can be used for restraining hair, and keeping it off of forehead and out of face.

In keeping with these objects and with others which will become apparent hereinafter, one feature of present invention resides, briefly stated, in a headband which is formed as a continuous non-elastic cord which has an inner size which is greater than a size of a head on which it is to be worn, having a tacky, breathable material provided on an inner surface of the cord, moisture repelling or absorbing material provided on an outer surface, and a fastener which a part of the cord is introduced so that the fastener can be displaced relative to the cord, and a portion of the cord can assume an inner size directly corresponding to the size of the head so that the headband will fit on the head.

When the headband is designed in accordance with the present invention, it provides the above mentioned highly advantageous results.

The device is designed for active females, but also can be used for active males and children in all activities requiring hair to be tied back, including athletics, casual activities, apparel and beauty apparel, gardening, hospital care, food preparation, etc.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
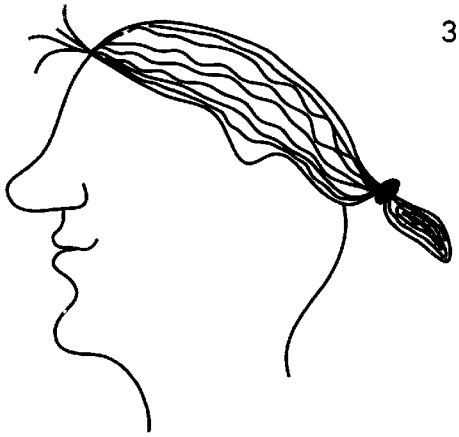
FIG. 1 is a view schematically showing a customer without a headband in accordance with the present invention.

A headband in accordance with the present invention is identified as a whole with reference numeral 1. It is used for holding hair off of forehead and out of face. The headband in accordance with the present invention is composed of a continuous non-elastic cord 2. The length of the cord 2 more particularly its inner size, is selected so that it is greater than the corresponding size of the head, so that when the cord 2 is placed on the head it does not fit the head but instead is substantially greater.

Figure 2:
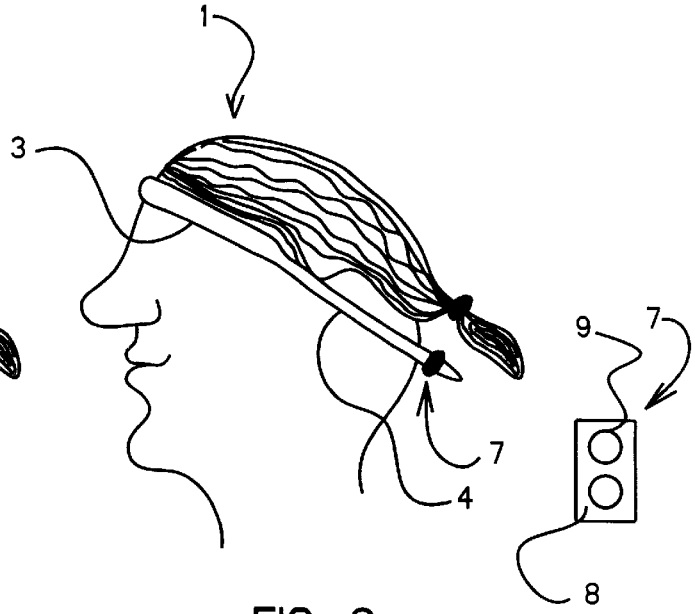
FIG. 2 is a side view of a customer who wears the inventive headband.
Figure 3:
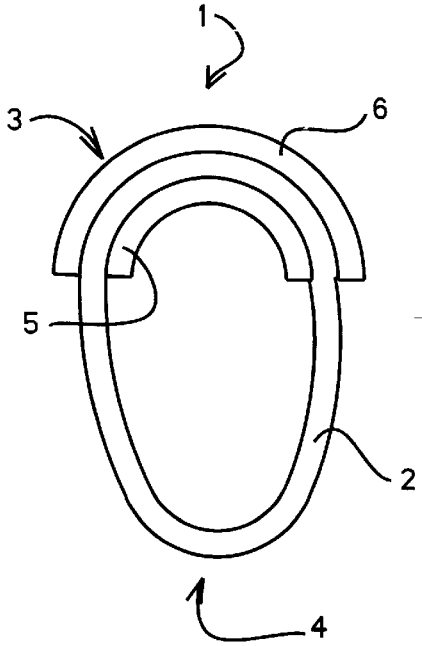
FIGS. 3–5 are views showing three different embodiments of the present invention.
Figure 4:
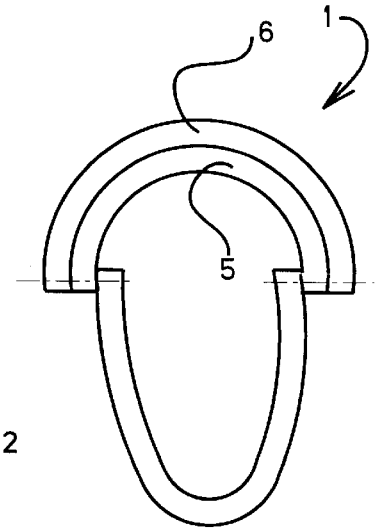
Figure 5:
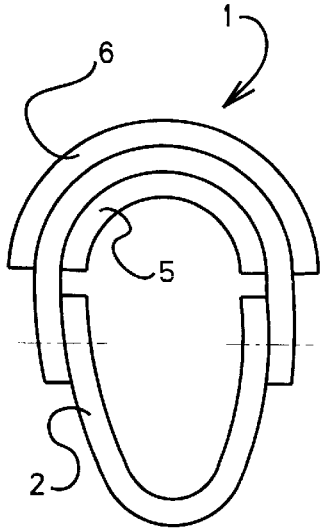

The cord 2 includes a front band shaped part 3 and a rear narrower cord-shaped part 4. The band-shaped part 3 is broader, while the cord-shape part 4 is narrower as shown in FIG. 2. The parts 3 and 4 can integral, one piece with another as shown in FIG. 3 or connected with one another, for example by sewing as shown in FIGS. 4 and 5. The band-shaped part 3 is provided with a tacky, breathable material on its inner surface as identified with reference numeral 5. On the outer surface, the band-shaped part 3 of the cord is provided with a moisture repelling material. Alternatively, the outer surface of the band-shaped part 3 of the cord can be provided with a moisture absorbing material.

The band-shaped part 3 can have for example a width of one inch on top. Then, the width reduces in the cord-shaped portion 4. The headband tapers off around ears, exposing thick, durable, non-elastic cord underneath.

The headband is further provided with a fastener which is identified as a whole with reference numeral 7. The fastener 7 can be composed for example of soft rubber. The fastener has a body which is identified with reference numeral 8 and provided with two holes 9.

The cord 2, in particular its cord-shaped part 4, loops through a fastener 7. More particularly, the cord 2 descends down one side of the head, loops through one hole 9, then loops back through the adjacent hole 9 and ascends up the other side of the head.

The fastener 7 is composed of a material with a friction coefficient selected so as to hold the cord 2 in its holes. For example the cord 2 can be composed of fabric, which the fastener 7 can be composed of rubber.

By pulling the fastener 7 upwardly, the size of the main portion of the headband reduces so as to fit exactly to the head of the user. A small portion of the cord extends outwardly beyond the fastener 7.

The headband has to be placed on a head approximately one inch behind the hairline. The fastener 7 is to be located at a base of a back of the head and tightened to a head size.

It is to be understood that since the fastener is composed of rubber, it has a friction which is sufficient not to move relative to the cord after adjusting a size of said front portion.

In accordance with the present invention, the cord 2 can be formed for example as a nylon cord. The moisture repellant material can be for example a neoprene nylon. The tacky material can be for example a synthetic rubber. As can be seen from FIG. 3, the cord 2 is formed as an integral, one piece cord. The materials 5 and 6 are attached to the corresponding surfaces of the cord.

In accordance with another embodiment shown in FIG. 4, the materials 5 and 6 are attached to one another, and the thusly formed combination part 3 is attached to the cord part 2, for example by sewing with the sewing seams. In accordance with still another embodiment (shown in figures) of the present invention, the band-shaped part 3 has a carrier fabric which can be a carrier fabric connected with the cord part 2, for example by sewing, and the carrier fabric 3 is provided at both sides with the materials 5 and 6.

It will be understood that each of the elements described above, or two or more together, may also find a useful application in other types of constructions differing from the types described above.

While the invention has been illustrated and described as embodied in headband for holding hairs off of forehead and out of face, and method of making the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A headband for holding hairs off of forehead and out of face, comprising a cord which has an inner size adapted to exceed an outer size of a head of a user; and a fastener provided with a structure through which at least a portion of said cord can pass, so that by displacing said fastener relative to said cord, a front portion of said cord is reducible to fit exactly the head of the user, said cord having a band-shaped part with a greater width and a cord-shaped part with a smaller width integrally connected of one-piece with one another.

2. A headband as defined in claim 1, wherein said band-shaped part has an outer surface provided with a moisture-repellant material.

3. A headband as defined in claim 1, wherein said band-shaped part has an outer surface provided with a moisture-absorbing material.

4. A headband as defined in claim 1, wherein said fastener has hole means through which said cord passes.

5. A headband as defined in claim 2, wherein said band-shaped part consists of two different materials applied on one another.

6. A headband as defined in claim 2, wherein said band-shaped part has an inner layer connected with said cord-shaped part, and two different materials arranged on opposite sides of said layer.

7. A headband for holding hairs off of forehead and out of face, comprising a cord which has an inner size adapted to exceed an outer size of a head of a user; and a fastener provided with a structure through which at least a portion of said cord can pass, so that by displacing said fastener relative to said cord, a front portion of said cord is reducible to fit exactly the head of the user, said band-shaped part having an inner surface provided with a tacky, breathable material.

* * * * *